US007690916B2

(12) United States Patent
Bulthaup et al.

(10) Patent No.: US 7,690,916 B2
(45) Date of Patent: Apr. 6, 2010

(54) METHOD AND APPARATUS FOR OPERATING A GAS-POWERED COOKING AND FRYING DEVICE

(75) Inventors: Fred Bulthaup, Kirchlengern (DE); Andreas Telkemeier, Buende (DE)

(73) Assignee: Miele & Cie. KG, Guetersloh (DE)

( * ) Notice: Subject to any disclaimer, the term of this patent is extended or adjusted under 35 U.S.C. 154(b) by 871 days.

(21) Appl. No.: 10/413,071

(22) Filed: Apr. 14, 2003

(65) Prior Publication Data

US 2003/0192530 A1 Oct. 16, 2003

(30) Foreign Application Priority Data

Apr. 16, 2002 (DE) ..... 102 17 008

(51) Int. Cl.
*F23N 5/20* (2006.01)

(52) U.S. Cl. ..... 431/24; 431/25; 431/80; 126/39 G

(58) Field of Classification Search ..... 431/24 O, 431/25 X, 80 X; 126/42 X, 351.1, 39 G
See application file for complete search history.

(56) References Cited

U.S. PATENT DOCUMENTS

| | | | | |
|---|---|---|---|---|
| 3,554,680 | A * | 1/1971 | Malavasi | 431/78 |
| 4,384,792 | A | 5/1983 | Sommers et al. | |
| 5,722,823 | A * | 3/1998 | Hodgkiss | 431/43 |
| 6,322,352 | B1 | 11/2001 | Zink et al. | |
| 6,439,878 | B1 * | 8/2002 | Kawauchi et al. | 431/70 |
| 2002/0073985 | A1 * | 6/2002 | Leukhardt, III et al. | 126/39 E |

FOREIGN PATENT DOCUMENTS

| | | |
|---|---|---|
| CH | 303445 | 2/1955 |
| DE | 1529038 | 6/1969 |
| DE | 1629860 | 10/1971 |
| DE | 2550219 | 5/1977 |
| DE | 2708645 | 9/1977 |
| DE | 2928739 | 6/1980 |

(Continued)

OTHER PUBLICATIONS

Imperial Multi-Line: Operating Instructions; Gas Hob "WOK", MGW 2 LS; Mar. 1995; pp. 1-28; Publication No. MN 39132/0395; [English-language version submitted herewith: Imperial Werke GmbH & Co., Installstrasse 10-18, 32255 Buende, Germany; English Publication No. MN 39133/00-0498].

(Continued)

*Primary Examiner*—Alfred Basichas
(74) *Attorney, Agent, or Firm*—Darby & Darby

(57) ABSTRACT

A method and an apparatus for operating a gas-powered cooking device including an actuator for moving a closure disposed in the gas feed conduit of a burner to an open state and of igniting gas emitted from the burner by an ignition electrode to form a burner flame, the ignition electrode being connected to an ignition voltage for a predetermined first interval of time, a sensor thermo-conductively connected to the burner flame for generating a sensor voltage for maintaining the closure means in its open state if the sensor voltage attains a predetermined level and of initiating subsequent ignitions after a predetermined interval of time where the predetermined level is not attained within a predetermined further interval of time.

18 Claims, 2 Drawing Sheets

FOREIGN PATENT DOCUMENTS

| | | |
|---|---|---|
| DE | 3721153 | 1/1989 |
| DE | 4225789 | 2/1993 |
| DE | 4446237 | 6/1996 |
| DE | 1094685 | 12/1996 |
| DE | 196 27 539 | 1/1998 |
| DE | 19627539 | 1/1998 |
| DE | 196 41 920 | 4/1998 |
| DE | 19641920 | 4/1998 |
| DE | 197 44 770 | 4/1999 |
| DE | 19744770 | 4/1999 |
| DE | 19825846 | 12/1999 |
| EP | 0321858 | 6/1989 |
| EP | 0514212 | * 11/1992 |
| EP | 1215441 | 6/2002 |
| GB | 1144372 | 3/1969 |
| GB | 1569762 | 6/1980 |

OTHER PUBLICATIONS

"Der Gasherd"; pp. 1-19; Publication No. GP 588 (Aug. 1998); published by BGW, Bundesverband der deutschen Gas- und Wasserwirtschaft e.V. ; Josef-Wirmer-Strasse 1; 53123 Bonn, Germany.

* cited by examiner

METHOD AND APPARATUS FOR OPERATING A GAS-POWERED COOKING AND FRYING DEVICE

Priority is claimed to German patent application DE 102 17 008.8, filed Apr. 16, 2002.

The invention, in general, relates to a method and apparatus for operating a gas-powered cooking and frying device, and, more particularly, to a method and apparatus of the kind referred to provided with an actuator for moving a valve disposed in the gas feed of the device to an open state, with an ignition electrode for generating an ignition spark for igniting the combustible gas mixture flowing from the burner, with a control unit for electrically connecting the ignition electrode to a source of ignition voltage for a predetermined first interval of time, and with a sensor thermally conductively connected with the flame of the burner, the sensor generating an electrical sensor voltage for maintaining the valve in its open state.

BACKGROUND

A method is known for operating a gas-powered cooking device in which a rotary knob provided with a keying function is used as an actuator. When actuating the keying function, a closure means structured as a magnetic insert and disposed in a gas feed of a burner is moved from a closed to an open state. This leads to the magnetic insert to be moved from a closed to an open state against the bias of a spring mounted on the magnetic insert. There is provided yet another valve in the gas feed which may be opened by rotating the rotary knob. Only after this has occurred will gas flow from the burner. At the same time, by rotating the rotary knob, a timer in a control unit will be actuated electrically to connect the ignition electrode for a predetermined first interval of time to a source of ignition voltage. The ignition electrode releases an ignition spark for igniting the gas mixture flowing from the burner. A thermo-sensor is arranged in the cooking device in thermo-coupled connection with the flame of the burner to generate an electrical sensor voltage for maintaining the magnetic insert in its open state. If the keying function is no longer actuated and if the electrical sensor voltage is insufficient, the magnetic insert is automatically returned, by the bias of the spring, to its closed state, and the gas feed to the burner is interrupted again. This may happen, for instance, if after ignition the flame of the burner has failed sufficiently to heat the thermo element or if the flame of the burner is extinguished by a draft. In that case, the ignition described about has to be carried out anew. Therefore, one disadvantage of the known method is that every time the burner flame is extinguished the feed of gas is interrupted by the magnetic insert, and renewed manual ignition is necessary.

SUMMARY

Therefore, it is an aspect of the invention to provide a method of operating a gas-powered cooking or frying device by which following a first manual ignition renewed ignition is performed automatically in case the burner flame has been extinguished.

The present invention provides an apparatus and method for operating a gas-powered stove. An actuator is included for moving a valve in the line of a gas feed conduit for a burner to an open state. An ignition electrode generates an ignition source for igniting a combustible mixture emitted by the burner, thereby forming a burner flame. A sensor, connected to the burner flame by heat conductance, generates an electric sensor voltage over a predetermined temporal course to maintain the valve in an open state. Also included is a control unit for electrically connecting the ignition electrode to an ignition voltage for a predetermined first interval of time. The control unit includes an evaluation circuit for processing the electric sensor voltage to connect the ignition electrode to the ignition voltage in response to a switching state dependent on the temporal course of the electric sensor voltage.

BRIEF DESCRIPTION OF THE DRAWINGS

The novel features which are considered to be characteristic of the invention are set forth with particularity in the appended claims. The invention itself, however, in respect of its structure, construction and lay-out as well as manufacturing techniques, together with other objects and advantages thereof, will be best understood from the following detailed description when read in connection with the appended drawings, in which:

DETAILED DESCRIPTION

Figure 1:
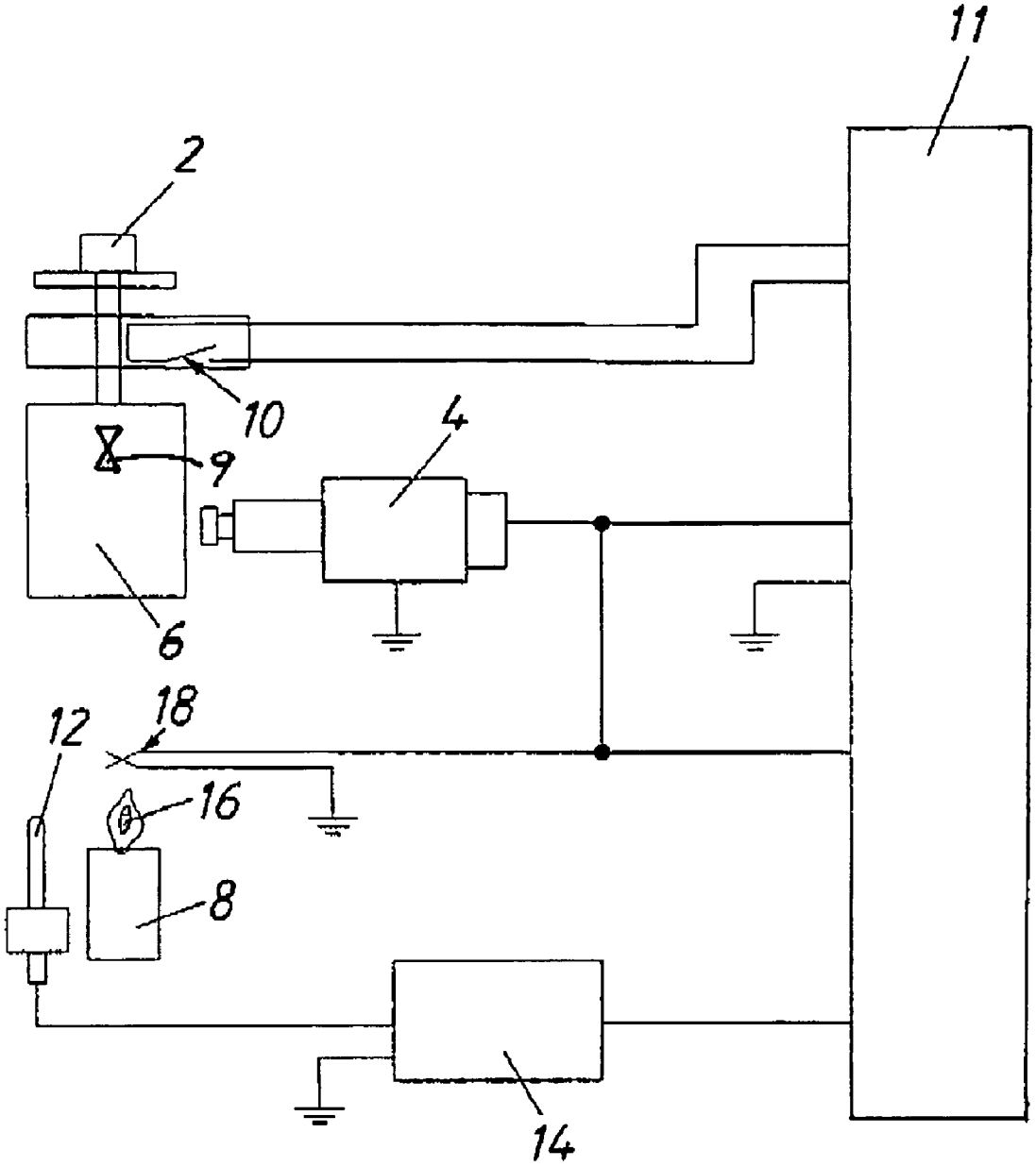
FIG. 1 is a block circuit diagram of the device for practicing the method of the invention.

In addition to the automatic re-ignition after extinction of the burner flame and the operational ease for a user, the advantages derived from the invention include that the sensor, which in the known method serves the sole function of generating, at an existing burner flame, a sufficiently high electric sensor voltage for maintaining a valve in its open state to prevent interruption of gas feed to the burner during operation of the cooking device, additionally functions electrically to connecting the ignition electrode to the source of ignition voltage in dependence of the electric sensor voltage. While it is known instead of the safety arrangement described above i.e. to return the valve to its closed state in case the thermo-element fails to generate a sufficiently high electric sensor voltage, to use an ignition electrode for additionally sensitizing the ionization of air and for initiating a re-ignition in response to this signal. However, a disadvantage of such an arrangement is that in case of an electric power failure no re-ignition can take place, and gas will continue to flow from the burner with a potentially explosive mixture is developing in the room in which the cooking and frying device is installed.

In a specific embodiment of the invention an electric signal is fed from the actuating means to the control unit to be processed in a second evaluation circuit of the control unit for maintaining the valve, by the second evaluation, in its open state for a predetermined second interval of time depending upon the electric signal. This further improves the ease of operation for a user as a single and short-time actuation of the actuator during an ignition operation is sufficient. Hence, actuation of the actuator up to the point in time at which the valve is maintained in its open state by the electric sensor voltage is no longer necessary.

Another embodiment provides for the valve to be maintained in its open state for a second interval of time by an electric holding voltage generated by the control unit and for processing the second interval of time by a safety circuit separate from the control unit and for electrically separating, upon expiration of the second interval of time, the electric holding voltage from the valve for an indefinite third interval of time. The safety of the method is thus improved further as upon expiration of the second interval of time the valve is disconnected from the holding voltage independently of the control unit so that during the third interval of time the valve is maintained in its open state solely by a sufficiently high electric sensor voltage.

Another embodiment of the invention provides for the first evaluation circuit of the control unit processing the change over time of the electric sensor voltage. Thus, extinction of the burner flame may be detected in advance and unnecessary re-ignition may be substantially prevented.

In yet another embodiment of the invention, the valve is moved to its open state and the electric signal is simultaneously fed to the control unit by the actuator. This provides for improved ease of operation to a consumer.

In principle, kind, size, material and number of the actuator may be selected from a wide variety. As a matter of efficiency, the actuator is structured as a rotating dial with an integrated keying function. A touch screen serves as another efficient and useful actuator.

In still another embodiment of the invention the valve is provided with a magnetic insert provided with a spring, the bias of which counteracts the magnetic force generated by the electric sensor voltage or electric holding voltage and returns the magnetic insert to its closed state. In this manner, the valve is returned to its closed state whenever the electric sensor voltage or the electric holding voltage is insufficiently high to maintain the valve in its open state.

In another embodiment of the invention the control unit is provided with a micro-processor with the first and/or the second evaluation circuit being an integrated circuit of the micro-processor. Micro-processor are advantageous and efficient components requiring little space.

The sensor may be a thermo-element in view of the fact that thermo-elements are cost-efficient standard components.

FIG. 1 depicts an embodiment of the device for practicing the method in accordance with the invention. The cooking device, which is shown only partially, is provided with actuator 2 structured as a rotary selection switch with an integrated keying function. Alternalitively, actuator 2 may be a touch screen. The actuator 2 cooperates mechanically with valve 4 structured as a magnetic insert. In a state that is not shown, the valve 4 blocks the flow path of a gas feed conduit 6 to a burner 8 and in its shown open state it does not block the flow path. The magnetic insert 4 is provided with a spring which biases the magnetic insert 4 in the direction of the closed state. The actuator 2 is mechanically connected with a valve (not shown) disposed in the gas feed conduit 6. Further more, a main switch 10 may be actuated by the actuator 2. The main switch 10 is disposed in a first circuit which is electrically connected to a micro-processor functioning as a control unit 11. An ignition electrode 12 is arranged in spatial proximity to the burner 8. Moreover, the ignition electrode 12, an ignition relay and a source of ignition voltage 14 are arranged in an ignition circuit. The ignition relay is actuated by the control unit 11. In spatial proximity and in a heat-transfer connection with the flame 16 of the burner 8 there is arranged a sensor 18 structured as a thermo-element. The thermo-element 18 is electrically connected to the magnetic insert 4 and with a first evaluation circuit of the control unit 11. The magnetic insert 4, a holding voltage relay and an electric holding voltage generated by the control unit 11 are arranged in a holding voltage circuit. The holding voltage relay may be actuated by the control unit 11.

Figure 2:
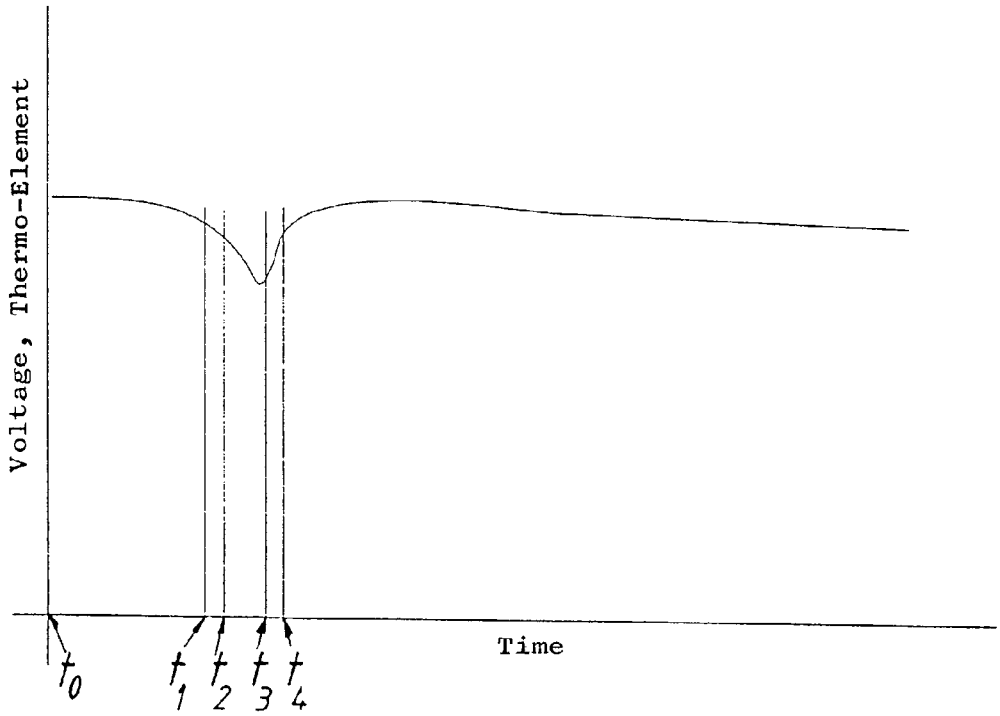
FIG. 2 is a graph exemplarily depicting the course over time of the electric sensor voltage.

Hereafter, the function of the method of the invention and of the embodiment of the device for practicing the method will be explained with reference to FIGS. 1 and 2.

The cooking device in accordance with the invention is connected to a source of electricity. By actuating the keying function of the actuator 2 the magnetic insert 4 is mechanically moved to its open state (FIG. 1) against the bias of the spring connected to the magnetic insert 4. The valve in the gas feed conduit 6 is opened by rotating the actuator 2 in a counterclockwise direction. The flow path in the gas feed conduit 6 towards the burner 8 is thus open, and gas will be emitted by the burner 8. At the same time as the keying function of the actuator 2 is actuated, the main switch 10 in the first control circuit is closed, and an electric signal is fed to the control unit 11. This causes a first timing member in control unit 11 and the ignition relay to be actuated to connect the ignition electrode 12 for a predetermined interval of time to the ignition voltage 14. The ignition electrode 12 thus generates ignition sparks for igniting the gas emitting from the burner 8 and generating flame 16 of the burner 8. Upon expiration of the first interval of time, the ignition relay will again open the ignition circuit. Also, a second time member in the control unit 11 and the holding voltage relay are actuated so that the magnetic insert 4 is electrically connected to the holding voltage for a predetermined second interval of time so that the magnetic insert 4 is maintained in its open state. Thus, only a single and short-time actuation of the keying function of the actuator 2 is required. The thermo-element 18 is heated and the electric sensor voltage is generated by the flame 16 of the burner 8. Upon expiry of the second interval of time, the holding voltage relay again opens the holding voltage circuit. Provided the electric sensor voltage has reached a sufficiently high value, the magnetic insert 4 will be maintained in its open state by the electric sensor voltage, even after expiry of the second interval of time, so that the electric holding voltage is no longer required.

If the burner flame 16 is extinguished at this time, for instance by a draft of air, the electric sensor voltage at the first evaluation circuit of the control unit 11 is changed. In the present example, the evaluation circuit processes the change over time of the electric sensor voltage (see FIG. 2). FIG. 2 qualitatively depicts an exemplary course over time of the electric sensor voltage. The value of the electric sensor voltage is depicted on the ordinate; the abscissa identifies the time t. The course shown in FIG. 2 corresponds, from time $t_0$ to time $t_1$, to the course of the electric sensor voltage of the thermo-element 16 at a switched on cooking device and ignited burner flame 16. It is to be noted that the values shown in the graph are average values since the electric sensor voltage fluctuates within certain limits even during normal operation of the burner 8. There is a drop in the electric sensor value in the interval of time from $t_1$, to $t_2$. The first evaluation circuit compares the voltage drop measured in the interval of time $t_1$, to $t_2$ against a predetermined temporal course of the voltage drop which coincides with the extinction of the burner flame 16. The voltage drop of the example of FIG. 2 corresponds to the predetermined temporal course of the voltage drop, and the ignition relay is again actuated by the first evaluation circuit of the control unit 11. The ignition circuit is thus closed and the ignition electrode 12 is again connected to the ignition voltage 14 to generate ignition sparks for igniting the burner flame 16 again. In the mean time, time $t_3$ has been reached (see FIG. 2). Analogous to the voltage drop, the first evaluation circuit compares the rise in voltage measured during time interval $t_3$ to $t_4$ against a predetermined temporal course of the rise in voltage. The rise in voltage of the example of FIG. 2 corresponds to the predetermined temporal course of the rise in voltage, and the ignition relay is actuated by the first evaluation circuit of the control unit 11 such that the ignition circuit is opened and the ignition electrode 12 is disconnected from the ignition voltage 14. Upon reaching time $t_4$ the voltage course will have reached the average value characteristic of normal operation of the burner 8. The evaluation circuit is structured such that a drop in the voltage of the sensor voltage caused by normal operation of the cooking device, for instance by reducing the gas feed by rotation of the actuator 2 in a counter-clockwise direction, does not result in re-ignition as described above. This may be achieved by utilizing the temporal change in electric sensor voltage which during an intended reduction of the gas flow drops more slowly than it would with an undesired extinction of the burner flame 16.

The described embodiment is additionally provided with a safety circuit which constitutes a safety device electrically connected to the control unit 11. The safety circuit includes third and fourth timing members and a safety relay. The safety relay opens the holding voltage circuit in response to a signal from the third timing member. The third timing member is actuated after the holding voltage relay has been closed in the manner described supra. Upon expiry of the predetermined second interval of time the safety relay is actuated by the third timing member to open the holding voltage circuit. At the same time the fourth timing member is actuated for clocking a predetermined third interval of time. During the third interval of time the magnetic insert 4 is disconnected from the electrical holding voltage, independent of the control unit 11. Provided the electric sensor voltage generated by the thermo-element 18 is sufficiently high to maintain the magnetic insert 4 in its open state, the flow path in the gas feed duct 6 remains unimpeded. This is the case as long as the burner flame 16 remains burning. In the present situation, if the burner flame 16 has been extinguished for any reason, the electrical sensor voltage will not be sufficiently high to maintain the magnetic insert 4 in its open state against the bias of its integrated spring. Upon expiry of the third interval of time the safety relay will therefore be actuated again to close the holding voltage circuit. Since the holding voltage relay is otherwise actuated in this manner only for purposes of a first manually initiated ignition during the predetermined second interval of time, the holding voltage circuit remains open until a renewed manually initiated initial ignition.

What is claimed is:

1. An apparatus for operating a gas-powered cooking device, comprising:

an actuator for moving a valve disposed in a gas feed conduit of a burner to an open state;

an ignition electrode operable to generate an ignition spark for igniting a combustible gas mixture emitted by the burner to form a burner flame;

a sensor connected to the burner flame by heat conductance operable to generate an electric sensor voltage that is applied to the valve so as to maintain the valve in the open state; and a control unit operable to electrically connect the ignition electrode to an ignition voltage for a predetermined first interval of time and comprising a first evaluation circuit for processing the sensor voltage and operable to again connect the ignition electrode to the ignition voltage in response to a temporal course of the electric sensor voltage so as to again form the burner flame.

2. The apparatus of claim 1, wherein the actuator is operable to substantially simultaneously move the valve to the open state and provide an electric signal to the control unit.

3. The apparatus of claim 2, wherein the actuator comprises a rotary selection knob with an integrated keying function.

4. The apparatus of claim 2, wherein the actuator comprises a touch screen.

5. The apparatus of claim 2, wherein the valve comprises a magnetic insert provided with a spring for biasing the magnetic insert against a force generated by the sensor voltage to the closed state of the valve.

6. The apparatus of claim 1, wherein the control unit comprises a micro-processor and wherein the evaluation circuit is integrated in the micro-processor.

7. The apparatus of claim 1, wherein the sensor comprises a thermo-element.

8. A method for operating a gas-powered cooking device, comprising the steps of:

moving an actuator so as to move a valve disposed in a gas feed conduit of a burner of the gas-powered cooking device to an open state so as to enable gas to flow from the burner;

supplying a holding voltage to the valve from the control unit during a predetermined time interval so as to hold the valve open;

electrically connecting an ignition electrode to an ignition voltage for a predetermined first interval of time so as to generate an ignition spark for igniting gas flowing from the burner and forming a burner flame;

thermo-conductively exposing a sensor to the burner flame so as to generate a sensor voltage over a predetermined course;

applying the sensor voltage to the valve so as to maintain the valve in the open state after the predetermined time interval;

processing the sensor voltage in a first evaluation circuit of a control unit; and electrically connecting the ignition electrode to the ignition voltage again in response to the course of the sensor voltage and without again moving the actuator so as to again ignite gas flowing from the burner and form a burner flame.

9. The method of claim 8, further comprising the step of:

causing the actuator to feed an electric signal to the control unit for processing in a second evaluation circuit; and maintaining the valve in the open state for a predetermined second interval of time depending upon the electric signal.

10. The method of claim 9, further comprising the steps of:

generating, by the control unit, a holding voltage for maintaining the valve in the open state for the predetermined second interval of time;

processing the second interval of time by a safety circuit independent of the control unit; and upon expiry of the second interval of time, electrically disconnecting the holding voltage from the valve for a predetermined third interval of time.

11. The method of claim 8, further comprising the step of processing, by the first evaluation circuit, temporal changes in the sensor voltage.

12. The method of claim 8, further comprising the steps of:

generating, by the control unit, a holding voltage for maintaining the valve in the open state for a predetermined second interval of time;

processing the second interval of time by a safety circuit independent of the control unit; and upon expiry of the second interval of time, electrically disconnecting the holding voltage from the valve for a predetermined third interval of time.

13. An apparatus for operating a gas-powered cooking device, comprising:

an actuator for moving a valve disposed in a gas feed conduit of a burner to an open state, the valve including a magnetic insert and a spring biasing the valve toward a closed state;

an ignition electrode operable to generate an ignition spark for igniting a combustible gas mixture emitted by the burner to form a burner flame;

a thermal sensor operable to generate an electric sensor voltage over a predetermined temporal course of the burner flame and configured such that the electric sensor voltage generates a force on the magnetic insert biasing the valve toward an open state; and a control unit operable to electrically connect the ignition electrode to an ignition voltage for a predetermined first interval of time and comprising a first evaluation circuit for processing the sensor voltage and operable to again connect the ignition electrode to the ignition voltage in response to the temporal course of the electric sensor voltage so as to again form the burner flame.

14. The apparatus of claim 13, wherein the actuator is operable to substantially simultaneously move the valve to the open state and provide an electric signal to the control unit.

15. The apparatus of claim 14, wherein the actuator comprises a rotary selection knob with an integrated keying function.

16. The apparatus of claim 14, wherein the actuator comprises a touch screen.

17. The apparatus of claim 14, wherein the valve comprises a magnetic insert provided with a spring for biasing the magnetic insert against a force generated by the sensor voltage to the closed state of the valve.

18. The apparatus of claim 13, wherein the control unit comprises a micro-processor and wherein the evaluation circuit is integrated in the micro-processor.

* * * * *